US010974793B2

(12) United States Patent
Smedal et al.

(10) Patent No.: US 10,974,793 B2
(45) Date of Patent: Apr. 13, 2021

(54) DISCONNECTABLE BOW TURRET

(71) Applicants: Cefront Technology AS, Arendal (NO); SCANA OFFSHORE AS, Vestby (NO)

(72) Inventors: Arne Smedal, Faervik (NO); Jan Aarsnes, His (NO); Kare Syvertsen, Tveit (NO); Torkjel Lisland, Drobak (NO)

(73) Assignee: Seasystems AS, Vestby (NO)

( * ) Notice: Subject to any disclaimer, the term of this patent is extended or adjusted under 35 U.S.C. 154(b) by 0 days.

(21) Appl. No.: 16/314,864

(22) PCT Filed: Jul. 4, 2017

(86) PCT No.: PCT/EP2017/066599
§ 371 (c)(1),
(2) Date: Jan. 3, 2019

(87) PCT Pub. No.: WO2018/007370
PCT Pub. Date: Jan. 11, 2018

(65) Prior Publication Data

US 2019/0152567 A1 May 23, 2019

(30) Foreign Application Priority Data

Jul. 5, 2016 (WO) ..... PCT/EP2016/065746

(51) Int. Cl.
*B63B 21/50* (2006.01)
*B63B 22/02* (2006.01)

(52) U.S. Cl.
CPC ..... *B63B 21/508* (2013.01); *B63B 22/023* (2013.01); *B63B 22/026* (2013.01); *B63B 2022/028* (2013.01)

(58) Field of Classification Search
CPC ... B63B 21/508; B63B 22/023; B63B 22/026; B63B 2022/028; B63B 21/00; B63B 21/50
(Continued)

(56) References Cited

U.S. PATENT DOCUMENTS 4,301,840 A * 11/1981 Jansen ..... B63B 21/50 137/615
4,650,431 A 3/1987 Kentosh
(Continued)

FOREIGN PATENT DOCUMENTS

EP 0134313 10/1987
GB 1189758-X 4/1970
(Continued)

*Primary Examiner* — Anthony D Wiest
(74) *Attorney, Agent, or Firm* — Christian D. Abel

(57) ABSTRACT

The invention concerns a vessel (1) for storing and/or producing hydrocarbons and a buoyant turret buoy (6) to be connected to the vessel (1). The outer surface of the bow (2) of the vessel (1) comprises a receiving structure (5) for connecting a buoyant turret buoy (6) to the bow (2). The main part of the receiving structure (5) protrudes from the lower part (4) of the bow (2) in the vessel's (1) direction of travel and an interface of the receiving structure (5) is complementary to an interface of a connecting section (17) of the buoyant turret buoy (6). Further the lower part (4) of the bow (2) is below the water line (w) during connection of the buoyant turret buoy (6) at sea. The invention also concerns a method for connecting the buoyant turret buoy (6) to receiving structure (5) of the vessel (1).

1 Claim, 4 Drawing Sheets

(58) Field of Classification Search
USPC ..... 114/230.12
See application file for complete search history.

(56) References Cited

U.S. PATENT DOCUMENTS

| | | | | | |
|---|---|---|---|---|---|
| 4,741,716 | A * | 5/1988 | Hasebe | B63B 21/507 | 114/230.15 |
| 4,955,310 | A * | 9/1990 | Pollack | B63B 21/507 | 114/230.12 |
| 5,025,742 | A * | 6/1991 | Urdshals | B63B 21/507 | 114/230.12 |
| 5,044,297 | A * | 9/1991 | de Baan | B63B 21/50 | 114/293 |
| 5,456,622 | A * | 10/1995 | Breivik | B63B 22/026 | 441/3 |
| 6,176,193 | B1 * | 1/2001 | Whitby | B63B 35/44 | 114/230.12 |
| 2013/0103364 | A1 * | 4/2013 | Kawakita | G06F 30/15 | 703/1 |

FOREIGN PATENT DOCUMENTS

| | | |
|---|---|---|
| GB | 2160166-X | 12/1985 |
| WO | WO 89/03338-X | 4/1989 |
| WO | WO 93/11031-X | 6/1993 |
| WO | WO 93/24732-X | 12/1993 |

* cited by examiner

DISCONNECTABLE BOW TURRET

TECHNICAL FIELD

The present invention generally relates to offshore vessels used for production and/or storage of petroleum products having a disconnectable buoyant turret buoy to moor the vessel and allow it to weathervane, wherein the buoyant turret buoy allows risers to be connected for the production of petroleum products. Further, the invention relates to a method for connecting the buoyant turret buoy to the vessel.

BACKGROUND AND PRIOR ART

The function of a turret is to moor a weathervaning vessel to a seabed without creating excessive forces on the mooring lines. This is achieved by use of a swivel and bearings that keeps the turret geostationary during vessel rotations. Turrets on storage or production vessels must also provide space for pipelines extending along an axial center of the turret. The swivel enables the transfer of fluid flows, communication signals, hydraulics and any power between the geostationary turret and the weathervaning vessel.

A turret mooring system often comprises a turret arrangement integrated in a vessel and permanently moored to the seabed. The turret arrangement comprises a bearing system allowing the vessel to rotate/weathervane around a fixed geostatic part of the turret arrangement without creating excessive forces on the mooring lines. Such integrated installation requires complex structural mounting arrangements attached to a suitable load bearing portion of the bow. Also, since the turret assembly is permanently installed, considerable work is required to remove the turret assembly. Further, due to the fact that the turret is permanently fixed to the vessel, it will be exposed to any weather conditions such as hurricanes which may cause damages.

As an example, patent publication GB1189758A discloses a conventional turret extending between the deck and the keel of a vessel. The turret is kept geostationary by a deck positioned rotatable table. A more recent example of a turret is disclosed in patent publication WO 98/56650, where a relatively small sized turret is located near the keel level of the vessel.

A vessel having a turret arrangement comprising a disconnectable turret buoy for mooring and/or risers for transferring of petroleum products is known. Such turret buoys are internally connected to a vessel inside the hull. The turret buoy allows relative rotation between 1) the seabed and associated risers and 2) the vessel, allowing the vessel to weathervane. Risers and mooring lines can be attached to the turret buoy also when the turret buoy is disconnected from the vessel.

A vessel having a disconnectable turret buoy for mooring and/or transferring of petroleum products is known for example from WO 93/11031 A and WO 93/24732 A.

The turret buoy has an outer buoyancy member arranged for introduction and releasable fastening in a submerged, downwardly open receiving space inside the hull of the vessel. Since the receiving space is situated inside the hull of the vessel, the water gathered above the turret buoy must be drained out to connect the risers within the turret buoy with the swivel. Further, the inventions requires rebuilding of vessels, such as shuttle tankers, for transition to production vessels, and the installation and operation of the turret buoy and the connection and inspection of risers is complicated.

U.S. Pat. No. 8,225,732 B1 discloses a solution where a tanker is converted to a floating production ship by a vertical opening being cut in the hull. A cassette composed of plate elements is inserted into this opening, and a turret is mounted into the cassette. Another example of a disconnectable turret is found in Korean patent publication KR101512692 disclosing a turret being mounted on a dedicated turret support structure.

U.S. Pat. No. 4,650,431 A discloses a disconnectable transfer structure that can be connected to a bifurcated mooring structure situated under the water line at the bow of a dedicated vessel. However, this setup does not allow easy maintenance during operation.

Thus, there is an object of the invention is to provide a turret assembly for mooring a production vessel to a seabed and for transferring fluids from a subsea flowline to the vessel, which mitigate at least some of the above mentioned short-comings.

A particular object of the present invention is to provide a vessel that requires few modifications of the vessel, as well as a simple configuration of the receiving structure for receiving a disconnectable turret buoy.

A second object of the present invention is to obtain a simplified installation and operation of the turret buoy, and a simplified inspection of risers, compared to the prior art.

A third object of the present invention is to enable the use of existing winches on for example a Floating Production, Storage and Offloading (FPSO) vessel for buoy pull-in, mooring line hook-up, riser connection, swivel handling etc.

A fourth object of the present invention is to provide a simplified mechanism for locking the turret buoy to the vessel, and a simplified inspection and maintenance of the locking arrangement compared to the prior art.

A fifth object of the present invention is to obtain a swivel system located in a dry and protected area, allowing safe and simple connection to the processing plant/risers/umbilicals on the vessel.

A sixth object of the present invention is to allow the vessel to weathervane while maintaining a continuous flow path for production fluids from the subsea well to the vessel.

A seventh object of the present invention is to provide an easy and quick disconnection of the turret buoy from the vessel.

An eights object of the present invention is to provide a protecting and tight fit between the vessel and the buoyant turret buoy.

SUMMARY OF THE INVENTION

The present invention is set forth and characterized in the main claims, while the dependent claims describe other characteristics of the invention.

In particular, the invention concerns a vessel for storing and/or producing hydrocarbons, wherein the vessel is connected to a disconnectable buoyancy turret buoy, and has the advantage that the turret buoy may be disconnected from the vessel e.g. in periods with severe weather like thunderstorms, cyclones and tornadoes. Further, the present invention provides a flexible design which can be adapted and optimized for the operation required.

The vessel comprises a deck and a hull, wherein the hull further comprises a bow having an upper part and a lower part. The outer surface of the bow further comprises a receiving structure fixed thereto for connecting the buoyant turret buoy to the bow, wherein the receiving structure protrudes from the outer surface of the bow in the vessel's direction of travel. At least a part of the receiving structure protrudes from the upper part of the outer surface of the bow, and is arranged above the water level during connection and/or disconnection of the buoyant turret buoy. However, the main part of the receiving structure protrudes from the lower part of the bow, i.e. the part of the bow arranged under the water level during connections and/or disconnection of the buoyant turret buoy.

In other words, the receiving structure comprises an upper end and a lower end, wherein the upper end is above water level during connection and/or disconnection of the buoyant turret buoy.

In one advantageous embodiment, between 70% and 99.5% of the bulk of the receiving structure protrudes from the lower part of the bow, i.e. being below the water line during connection and/or disconnection of the buoyant turret buoy, preferably between 80% and 99%, more preferably between 85% and 99% and even more preferably between 90% and 99%, for example 95%.

The receiving structure may be fixed to the outer surface of the bow of the vessel by welding.

The outer surface of the bow is described hereinafter as the surface on the outside of the bow that is exposed to the external environment outside the vessel.

The interface of the receiving structure is complementary to the interface of a connecting section of the buoyant turret buoy. The main function of the disconnectable buoyant turret buoy is to moor the vessel and to allow the vessel to weathervane. Further, the turret buoy allows risers and umbilicals to be connected to the vessel.

The lower part of the bow of the vessel is defined as the part of the bow arranged below the water line during connection of the buoyant turret buoy at sea, making it possible to use existing winches on vessels such as FPSOs for connecting the buoyant turret buoy, since only an upper part of the buoyant turret buoy constituting a minor part of the buoy needs to be lifted above the water level. Thus, the buoyant turret buoy comprises an upper and a lower end, wherein the upper end is above the water line during connection of the buoyant turret buoy. Preferably between 0.5% and 30% of the buoyant turret buoy needs to be raised above the water line during connection to the vessel, more preferably between 1% and 20%, even more preferably between 1% and 15% and even more preferably between 1% and 10%, for example 5%. The smaller the part of the turret buoy is that needs to be lifted above the water line, the less power is required by the winch to move the turret buoy on to the receiving structure. On the other hand, the part above the water line should be sufficient to allow operators to perform necessary work on the buoyant turret buoy and/or receiving structure during connection and/or disconnection.

In another advantageous embodiment, the receiving structure displays a recess directed towards the bow for receiving at least a part of the buoyant turret buoy. The recess is directed towards the bow alongside the vessel. At least a part of the buoyant turret buoy is situated inside the recess when connected to the receiving structure, and the interface of the recess on the receiving structure is complementary to the interface of the buoyant turret buoy. The recess thereby provides a protecting and tight fit between the vessel and the buoyant turret buoy. A protecting and tight fit is considered highly advantageous, particularly if there are tough weather conditions like storms in order to keep the buoyant turret buoy in place. The recess is preferably configured as a wedge shape in the direction towards the bow. The term "wedge shape" is hereinafter defined as an essentially wedge shape, hence allowing some parts of the recess to deviate from the wedge shape structure. The wedge shape is in the bow-aft direction.

Further, the depth of the recess in the direction towards the bow may be shallower at the upper end of the receiving structure relative to a lower end of the receiving structure.

In another advantageous embodiment, the receiving structure displays at least one cavity located at the lower end of the receiving structure, wherein the at least one cavity is open towards the seabed when the lower part of the bow of the vessel is submerged in sea.

The configurations of the receiving structure preferably contribute to a protective and tight fit between the interfaces of the receiving structure and the buoyant turret buoy.

In another advantageous embodiment, the receiving structure comprises a locking arrangement situated at the upper end of the receiving structure for reversibly locking the receiving structure to the buoyant turret buoy. The locking arrangement is not limited to a particular configuration, but may be a locking jack, clamp or latch comprising a mechanical fastener locking the buoyant turret buoy to the receiving structure. Further, since the locking arrangement is situated on the part of the receiving structure that is above the water line during connection and/or disconnection of the buoyant turret buoy, any need of maintenance to the locking arrangement between the receiving structure and the buoyant turret buoy can be carried out above the water line in a dry environment.

In another advantageous embodiment, the vessel comprises a rotary table protruding from the upper part of the bow. The rotary table is situated on a support structure that protrudes from the upper part of the bow in the vessel's direction of travel. Preferably the rotational axis of the rotary table is located directly above the centre of the turret shaft section of the buoyant turret buoy when the buoyant turret buoy is connected to the vessel.

In another advantageous embodiment, the deck comprises a protruding deck structure protruding from the bow in the vessel's direction of travel (aft-bow). The protruding deck structure should protrude enough to enable arrangement of a swivel arrangement thereto situated directly above the turret shaft section of the buoyant turret buoy when the buoyant turret buoy is connected to the vessel.

In another advantageous embodiment, the vessel comprises a winch for lifting the buoyant turret buoy up to a position in which connection to the receiving structure is feasible. The winch for lifting the buoyant turret buoy has a lifting capacity being higher than the weight of the at least partly submerged buoyant turret buoy to be connected, including any buoy suspending mooring lines and/or risers connected thereto.

The term "risers" is hereinafter intended to include risers for production of hydrocarbons from production wells at the seabed, and umbilicals, pipes, tubes and hoses to supply energy, chemicals etc. to a subsea system.

The invention also concerns the buoyant turret buoy to be connected to the receiving structure arranged at the bow of the vessel. The buoyant turret buoy comprises an outer buoyancy section which makes the buoyant turret buoy neutrally or positively buoyant when submerged in a body of water, a turret arrangement comprising an inner turret shaft section for guiding one or more risers therein, and a connecting section for connecting the buoyant turret buoy to the receiving structure of the bow of the vessel. Further, the interface of the connecting section is complementary to the interface of the receiving structure.

During operation the buoyant turret buoy is connected to the receiving structure of the vessel, and the shaft section of the turret buoy is kept geostationary during vessel rotations by mooring lines connected to a lower section of the turret shaft. The lower section is close to, or below, the bottom of the vessel allowing the mooring lines to freely run from the connection without interfering with the hull of the vessel. Further, the design of the turret buoy, the receiving structure and the low location of the mooring line connections allows for direct transfer of the mooring forces into the bottom structure of the vessel, and no reinforcement in the hull of the vessel is required.

In another advantageous embodiment the connecting section of the buoyant turret buoy is a radial extension being thinner at the upper end relative to the lower end relative to the centre axis of the turret shaft. Thus, the interface of the receiving structure comprising a recess is complementary to the interface of the connecting section of the buoyant turret buoy.

In another advantageous embodiment the lower end of the connecting section comprises at least one hook, wherein at least one of the at least one hook has a size and a position that renders possible insertion into the at least one cavity located at the lower end of the receiving structure of the vessel. Note that the term 'hook' should be interpreted as any configuration that may be inserted into the relevant cavity in order to create higher stability.

In another advantageous embodiment the connecting section of the buoyant turret buoy displays at least one incision at the upper end. The incision allows a larger interface between the buoyant turret buoy and the receiving structure and a closer connection between the two interfaces.

In another advantageous embodiment the upper end of the connection section comprises an attaching arrangement for locking the buoyant turret buoy to locking arrangement of the receiving structure of the vessel.

In another advantageous embodiment the turret shaft section of the buoyant turret buoy comprises a vertically extending channel enabling guiding of one or more risers vertically therein.

The invention also concerns a mooring arrangement for mooring the vessel connected to the buoyant turret buoy to a sea bed via mooring lines fixed to the lower section of the turret shaft of the buoyant turret buoy. When the turret buoy is connected to the vessel, the mooring lines moors the vessel via the turret shaft section of the turret buoy allowing the vessel to weathervane around the turret shaft section.

In an advantageous embodiment, the vessel comprises a winch having a lifting capacity being higher than the weight of necessary for lifting at least a part of the submerged buoyant turret buoy to a height above the water line. Preferably between 0.5% and 30% of the buoyant turret buoy needs to be raised above the water line during connection to the vessel, more preferably between 1% and 20%, even more preferably between 1% and 15% and even more preferably between 1% and 10%, for example 5%.

The invention also concerns a method for connecting a buoyant turret buoy located at sea to a bow of a vessel. The buoyant turret buoy is configured to ensure neutral buoyancy at a given submerged depth or positive buoyancy of the buoyant turret buoy in a body of water. The buoyant turret buoy comprises a turret shaft section having a vertically extending channel enabling guiding of one or more risers therein, a connecting section, mooring lines extending from the lower part of the turret shaft section and optionally one or more risers. The bow of the vessel comprises a receiving structure, which main part of the receiving structure protrudes from a lower part of the bow situated below the water line (w) of the vessel. Further, the outer radial interface of the connecting section is complementary to the interface of the receiving structure.

The method is characterized by the following steps:

a) connecting a winch wire hanging from a winch fixed to the vessel to a pick-up assembly connected to the buoyant turret buoy floating at or below the water line (w) of a body of water, b) lifting the buoyant turret buoy by the winch until the connecting section of the buoyant turret buoy is in a position where the upper end of the connecting section is in line with, or near in line with, an upper end of the receiving structure, and c) locking the buoyant turret buoy to the receiving structure by utilizing at least one locking arrangement fixed to the upper end of the receiving structure and at least one attaching arrangement fixed to the upper end of the buoyant turret buoy.

In the following description, numerous specific details are introduced to provide a thorough understanding of embodiments of the claimed vessel, buoyant turret buoy and method. One skilled in the relevant art, however, will recognize that these embodiments can be practiced without one or more of the specific details, or with other components, systems, etc. In other instances, well-known structures or operations are not shown, or are not described in detail, to avoid obscuring aspects of the disclosed embodiments.

DETAILED DESCRIPTION OF THE INVENTION

Figure 1:
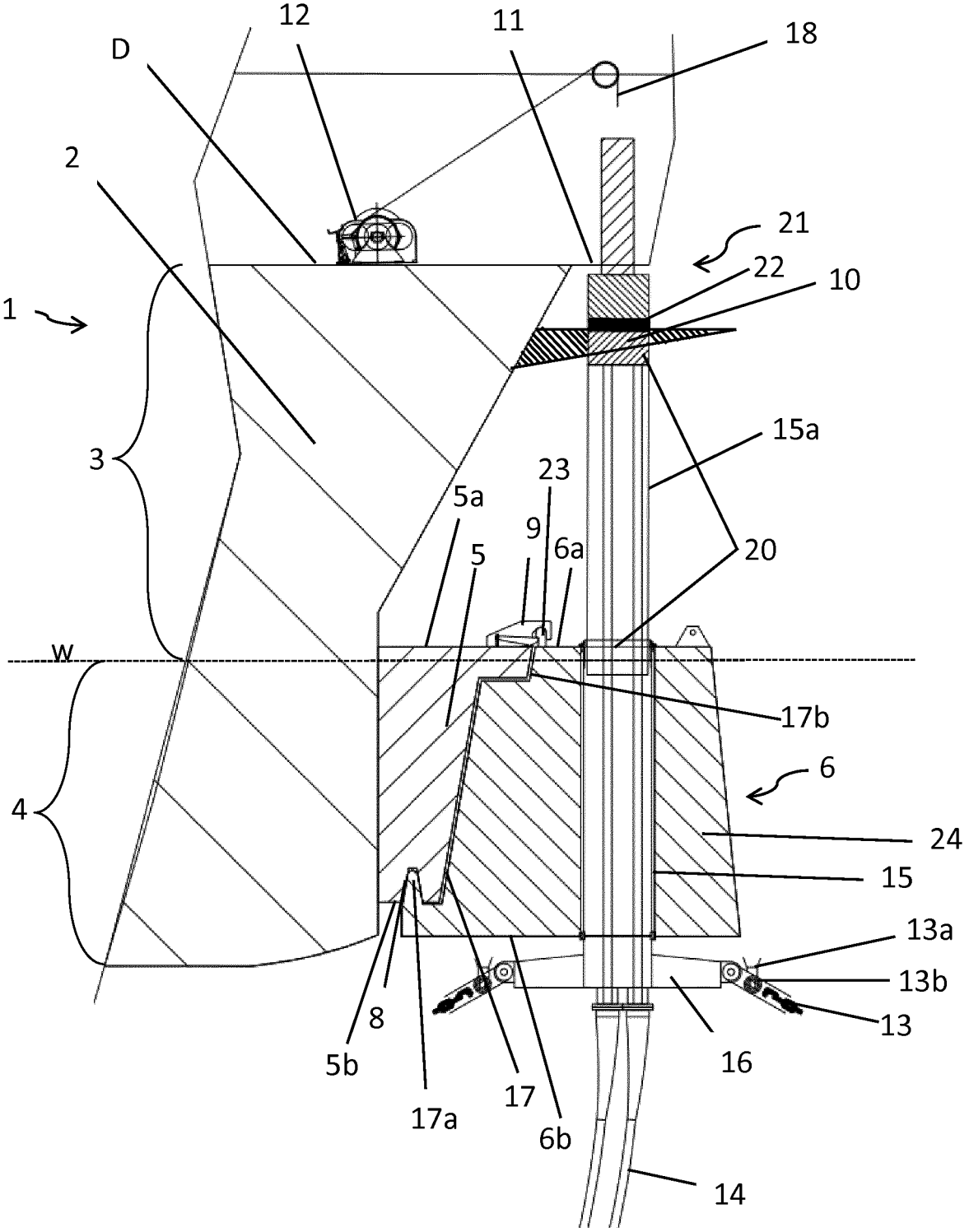
FIG. 1 is a perspective side view of a buoyant turret buoy connected to a receiving structure on a vessel according to the invention.
Figure 2:
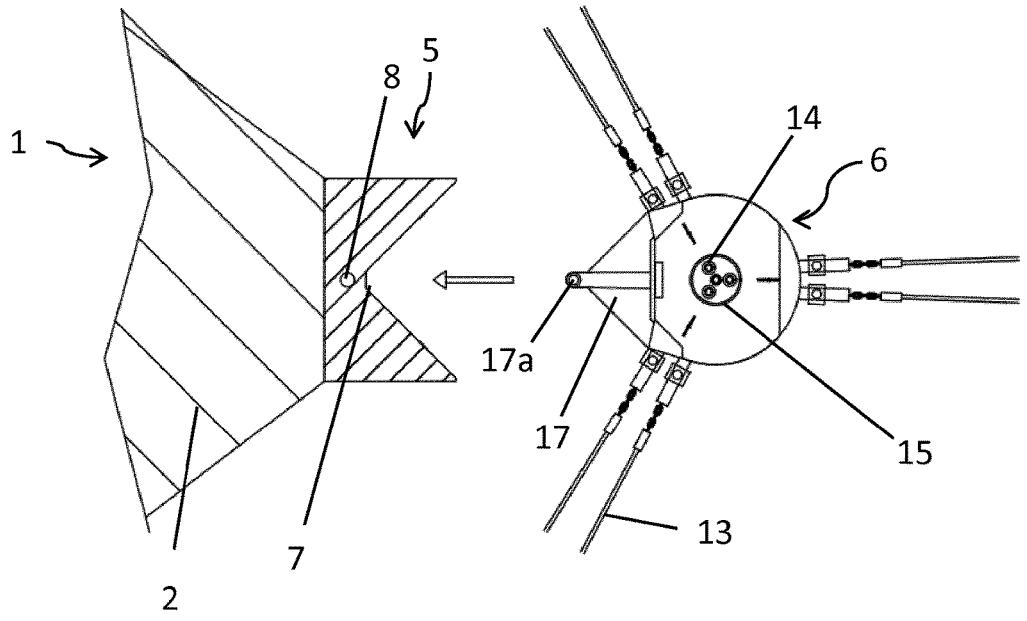
FIG. 2 is a perspective top view of a buoyant turret buoy to be connected to a receiving structure on a vessel according to the invention.

FIG. 1 shows an embodiment of the mooring arrangement for inter alia mooring a vessel 1 connected to a buoyant turret buoy 6. The buoyant turret buoy 6 is connected to a protruding receiving structure 5 fixed to the outer surface of the bow 2 of the vessel 1. The vessel 1 comprises a deck (D) having a protruding deck structure 11, and a hull comprising a bow 2 having an upper part 3 and a lower part 4, where the lower part is defined as the part of the hull situated below the water line (w) during connection of the buoyant turret buoy 6 to the receiving structure 5. As seen in FIG. 1, almost the entire bulk, for example between 70% to 99.5% of the bulk of the receiving structure 5, protrudes from the lower part 4 of the bow 2, i.e. below water level (w) during connection and/or disconnection of the buoyant turret buoy 6. The receiving structure 5 comprises a recess 7 serving as an opening for receiving the turret buoy 6. The recess 7 is illustrated in FIG. 2.

The interface of the receiving structure 5 is complementary to the interface of the buoyant turret buoy 6. In the embodiment shown in FIG. 1 the receiving structure 5 displays a cavity 8 at the structure's lower end 5*b*. The buoyant turret buoy 6 comprises a connecting section 17 which in FIG. 1 includes a hook 17*a* situated at the buoy's lower end 6*b*. The hook 17*a* has a complementary shape to the cavity 8. Further, the upper part of the buoyant turret buoy 6 comprises an incision 17*b* having a complementary shape as the protrusion at the structure's upper end 5*a*, thus achieving a stable and tight fit therebetween.

It can further be seen from FIG. 1 that the buoyant turret buoy 6 is locked to the receiving structure 5 through a locking jack 9. The locking jack 9 is situated at the structure's upper end 5*a* and locks to a vertically protruding hank 23 or similar situated at the buoy's upper end 6*a*. The resulting lock 9,23, combined with the structure of the interfaces of both the receiving structure 5 and the buoyant turret buoy 6, provides a reliable and stable connection of the buoyant turret buoy 6 to the receiving structure 5 of the vessel 1 during tough weather conditions like storms. Further, the locking jack 9 provides an easy disconnection of the buoyant turret buoy 6 in that the locking jack 9 is simple to open.

The buoyant turret buoy 6 has a buoyancy section 24 enabling the turret buoy 6 to float at a designated submerged water depth or to float on the water surface when the turret buoy 6 is not attached to the vessel 1.

Since the buoyant turret buoy 6 has risers 14 and mooring lines 13 attached thereto, the buoyancy of the turret buoy 6 matches the total weight of the turret buoy 6, including the risers 14 and mooring lines 13, to ensure equilibrium at the required submerged depth.

Further, the buoyant turret buoy 6 has a turret shaft section 15 comprising mooring lines 13 attached at its lower section 16. When the turret buoy 6 is connected to the vessel 1, the mooring lines 13 moors the vessel, 1 wherein the turret shaft section 15 allows the vessel 1 to weathervane during storage and production of hydrocarbons. The turret shaft section 15 has an integrated lower section 16 onto which the mooring lines 13 are connected via a mooring line connection 13*a*. A mooring line stopper 13*b* allows the mooring lines 13 to be tightened (see also FIG. 6).

The turret shaft section 15 further comprises an extendable rotatable channel 15*a* having a lifting and torque section 20. The lifting and torque section 20 has risers 14 connected thereto. The channel 15*a* can slide inside the turret shaft section 15 along guides which can lock the rotation of the channel 15*a* to the turret shaft section 15. The risers 14 attached to the channel 15*a* are thus kept geostationary and are transferring the torsion movement to the inner part of the risers 14 when the vessel 1 weathervanes.

FIG. 1 illustrates the risers 14 connected to a swivel arrangement 21 attached to the protruding deck structure 11 on the vessel 1, well above the loaded draft of the vessel 1. As can be seen from the figure, the lifting and torque section 20 is attached to a hang-off structure 22 on or above the rotary table 10. Thus, the risers 14 are kept geostationary in this position while the vessel 1 weathervanes. Further, a winch 12 is situated on the deck (D) with a winch wire 18 connected thereto. The wire 18 is configured to inter alia move the swivel arrangement 21 above the risers 14 to connect them together for production of hydrocarbons.

Figure 3:
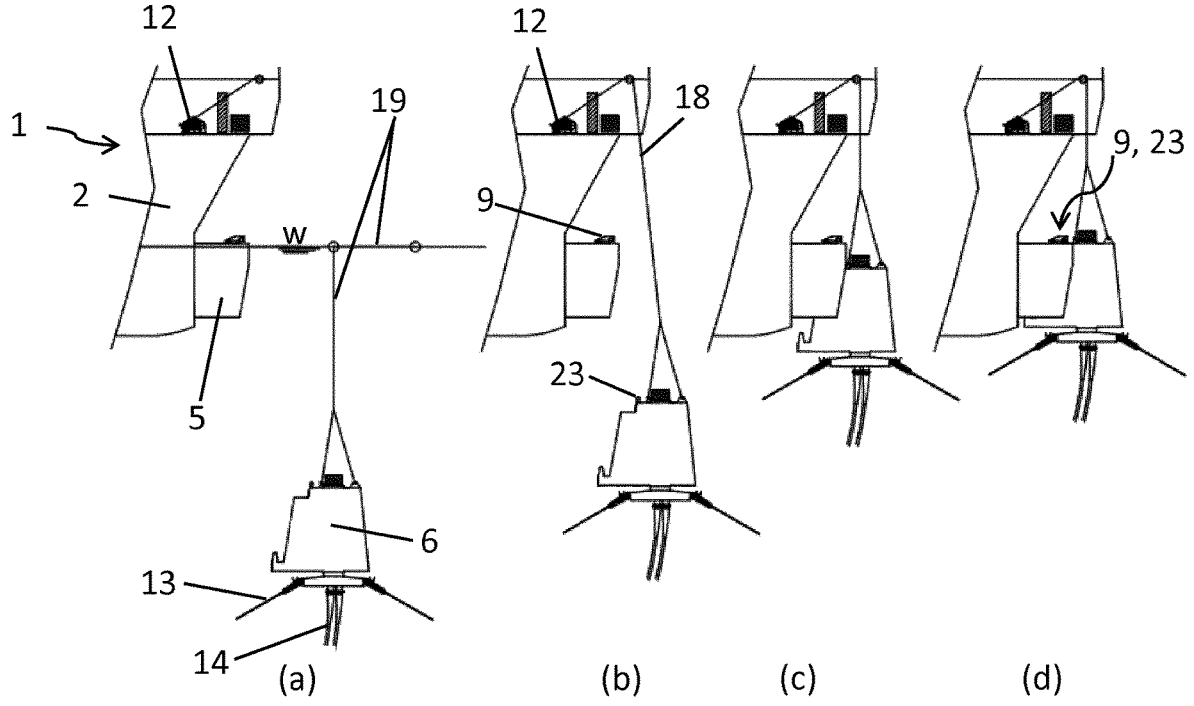
FIGS. 3 *a*), *b*), *c*) and *d*) show a perspective side view of the process of connecting a buoyant turret buoy to a receiving structure on a vessel according to the invention.

The winch 12 comprising the wire 18 is further configured to move and lift the buoyant turret buoy 6 from a submerged position at sea to the receiving structure 5 of the vessel 1 where the buoyant turret buoy 6 is connected to the receiving structure 5, which is illustrated in more detail in FIG. 3.

A top view of the buoyant turret buoy 6 including mooring lines 13 and risers 14 to be connected to the receiving structure 5 can be seen in FIG. 2. The figure shows the bow 2 of the vessel 1 comprising the protruding receiving structure 5. The receiving structure 5 displays a recess 7 for receiving the connecting section 17 of the buoyant turret buoy 6. Further the receiving structure 5 displays a cavity 8 compatible with the hook 17*a* of the turret buoy 6. As shown, the turret shaft section 15 with risers 14 is positioned substantially central inside the turret buoy 6.

As can be seen from the figure, only the interface at one side of the turret buoy 6 matches the interface of the receiving structure 5 of the vessel 1.

FIG. 3 (*a*) to (*d*) illustrates the method for connecting a buoyant turret buoy 6 in its idle position, e.g. at 30 meters' depth, to a receiving structure 5 on a vessel 1. As can be seen, the main part, for example between 70% and 99.5% of the receiving structure 5, is below the water level (w) during connection. The turret buoy 6 is submerged, having a pick-up assembly 19 connected to the turret buoy 6. A part of the pick-up assembly 19 is floating on top of the water level (w) and is picked up from the winch wire 18 hanging from the vessel's 1 winch 12. The winch 12 pulls the turret buoy 6 towards the receiving structure 5. The vessel's 1 heading should be controlled to match with the heading of the turret buoy 6. Finally, the turret buoy 6 is pulled-in and locked to the receiving structure 5 by the locking jack 9 on the receiving structure 5 and the protruding hank 23 on the turret buoy 6 as shown in FIG. 3 (*d*). During the connection of the buoyant turret buoy 6 to the vessel 1, a minor part of the buoyant turret buoy 6 is raised above the water level (w), for example between 0.5% and 30%.

Figure 4:
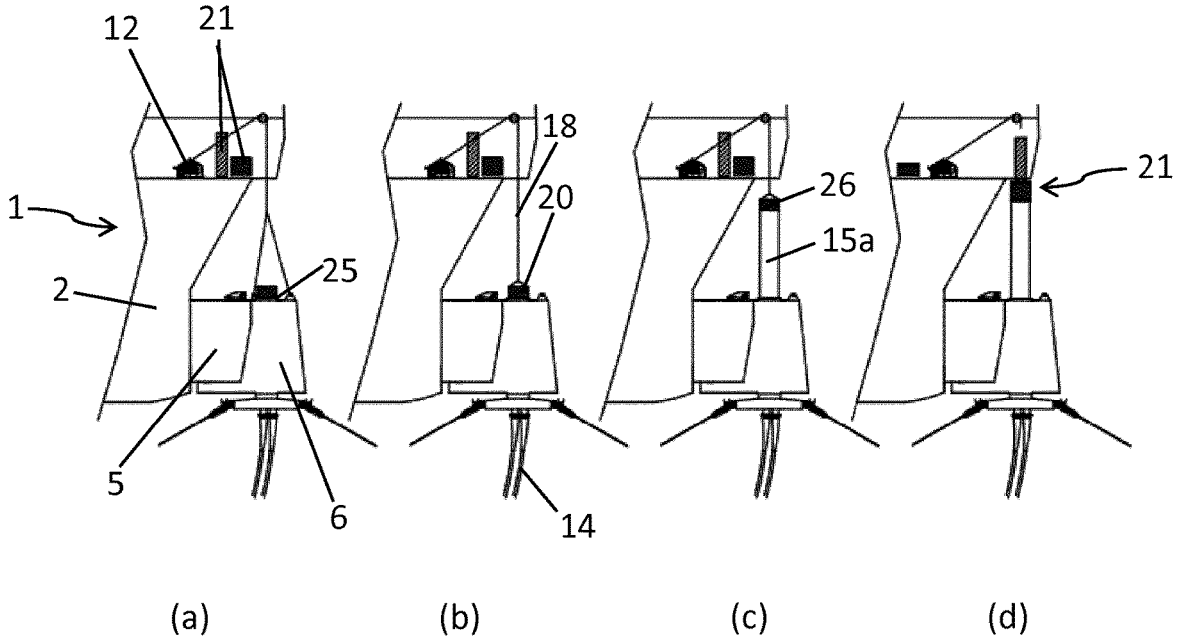
FIGS. 4 *a*), *b*), *c*, and *d*) show a perspective side view of a buoyant turret buoy connected to a receiving structure of the vessel and the process of connecting risers to a swivel arrangement according to the invention.

After the turret buoy 6 is locked to the vessel 1, the mooring lines 13 extending to the seabed are tightened if needed, and the connection of the risers 14 to the swivel arrangement 21 can follow as seen in FIG. 4.

FIG. 4 (*a*) to (*d*) illustrates how the risers 14 are connected to the swivel arrangement 21.

Step (a): The turret buoy 6 is connected to the receiving structure 5 of the vessel 1. The turret shaft section 15 (shown in FIG. 1) on the turret buoy 6 comprises risers 14 connected to the lifting and torque section 20.

Step (b): The winch wire 18 is connected to the lifting and torque section 20 situated on the extending channel 15*a*.

Step (c): The lifting and torque section 20 is lifted from a resting position 25 up to a rotary table 10 (shown in FIG. 1). The lifting and toque section 20 comprising the risers 14 is attached to a hang-off structure 22 (shown in FIG. 1) on or above the rotary table 10. The rotary table 10 allows the vessel 1 to weathervane while the risers 14 are kept geostationary.

Step (d): The winch wire 18 moves the swivel arrangement 21 into position above the risers 14 to connect the swivel arrangement 21 to the valve arrangement on the risers 14. The risers 14 may be locked to the swivel arrangement 21 by using bolts.

After flow lines/risers 14 are connected to the swivel arrangement 21, the FPSO/FSO can start operating.

Figure 5:
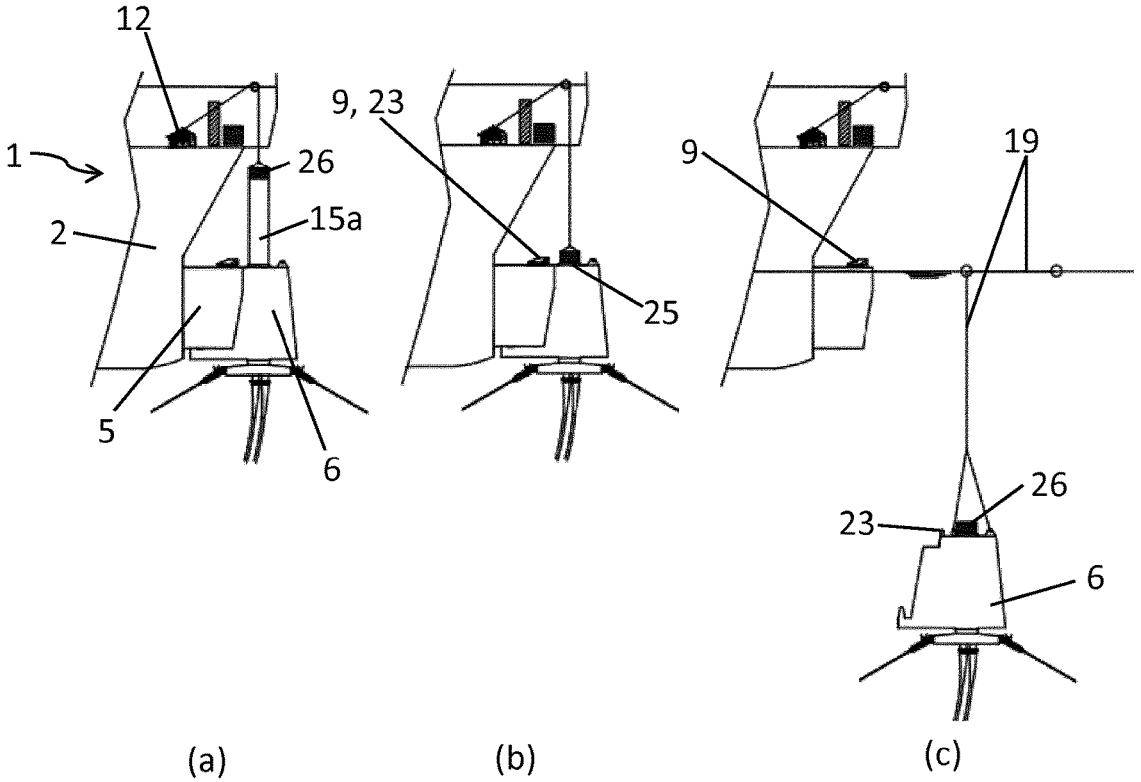
FIGS. 5 *a*), *b*) and *c*) show a perspective side view of disconnecting a buoyant turret buoy from a receiving structure of a vessel according to the invention.

FIG. 5 (*a*) to (*c*) illustrates the disconnection of the turret buoy 6 from the receiving structure 5 of the vessel 1.

Step (a): The flow lines/risers 14 bolted to the swivel arrangement 21 are disconnected and the swivel arrangement 21 is moved to its stored position on deck (D).

Step (b): The risers 14 are removed from the hang-off structure 22 and lowered by the extending channel 15*a* to its resting position 25 at the upper end 6*a* of the turret buoy 6. A pick-up assembly 19 is connected to the turret buoy 6 and the turret buoy 6 is now prepared for disconnection.

Step (c): The turret buoy 6 is disconnected by opening the locking jack 9. The disconnection may occur within a few seconds.

After disconnection, the buoyant turret buoy 6 is in an idle position and may float submerged at e.g. 30 meters' depth, but can also be left floating on the water surface. When the turret buoy 6 is left in its idle position floating on the water surface it will simplify the pick up and buoy connection to the receiving structure 5 compared to when the turret buoy 6 is submerged. This idle position may be adopted for operations where the disconnect is related to various stages of operations, while the submerged idle position may be adopted for operations where the disconnect is related to avoid severe weather conditions.

The risers 14 comprise a valve arrangement which is connected to the swivel arrangement 21 during operation. This valve arrangement is closed by e.g. closing valves and/or Emergency Shut Down (ESD) valves 26. These valves may be protected by a protective cover when the risers 14 are not operative, including the time when turret buoy 6 is submerged. When the risers 14 are to be connected to the swivel arrangement 21, the protective cover, closing valves and ESD valves 26 are removed by the winch wire 18 and stored on deck (D) during operation of the risers 14. Before the turret buoy 6 is to be removed from the vessel 1, the closing valves and ESD valves 26, and optionally the protective cover, are reconnected on to the risers 14 before lowering the risers 14 and the channel 15*a* to the resting position 25.

Figure 6:
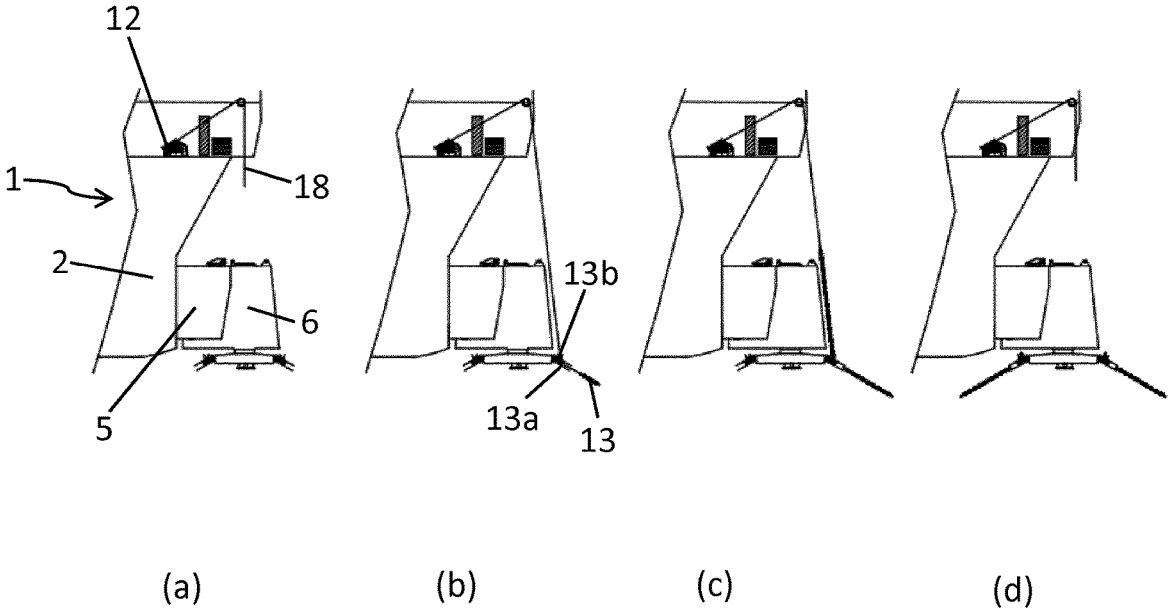
FIGS. 6 *a*), *b*), *c*) and *d*) show a perspective side view of connecting mooring lines to a buoyant turret buoy situated on the receiving structure of the vessel according to the invention.

FIG. 6 illustrates the connection of mooring lines/mooring chains 13 to a turret buoy 6 the first time the turret buoy 6 arrives at the production area where the production of hydrocarbons will occur.

Step (a): The vessel 1 has the turret buoy 6 locked thereto.

Step (b): The winch 12 utilized the winch wire 18 to pull in the mooring lines 13 one by one through the mooring line stopper 13*b* and the mooring line connection 13*a*.

Step (c): The mooring lines 13 are pretensioned.

Step (d): The extra length after the mooring line stopper 13*b* is cut off and removed. The mooring lines 13 may later be retensioned by using the same winch 12 if needed.

Figure 7:
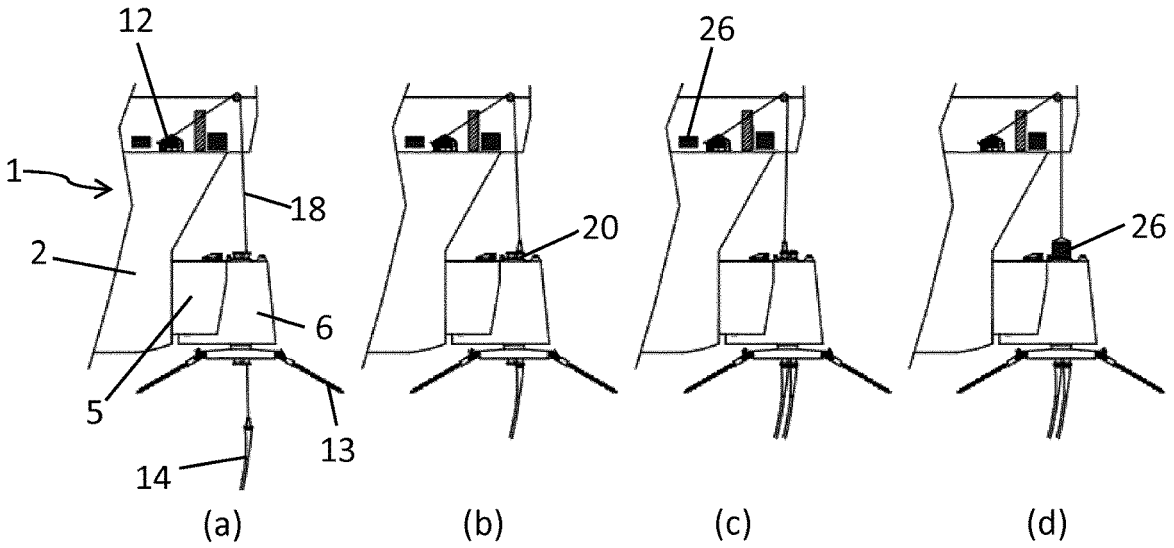
FIGS. 7 *a*), *b*), *c*) and *d*) show a perspective side view of connecting risers to a buoyant turret buoy connected to the receiving structure of a vessel according to the invention.

FIG. 7 (*a*) to (*d*) illustrates the connection of risers 14 to the turret buoy 6 when locked to the vessel 1. The connection of the risers 14 occurs after the mooring lines 13 have been connected to the turret buoy 6 as shown in FIG. 6.

Step (a): The winch wire 18 is lead through the turret shaft section 15 (shown in FIG. 1) and connected to a riser 14 situated below the turret buoy 6.

Step (b): The winch 12 pulls in the riser 14 and connects the riser 14 to the lifting and torque section 20 of the turret shaft section 15.

Step (c): Steps (a) to (b) are repeated until all the risers 14 are connected to the lifting and torque section 20.

Step (d): Closing valves and ESD valves 26 are connected to the valve arrangement on top of the risers 14. A protective structure can be placed on top thereof covering the valves.

After the process described in FIG. 7, the risers 14 are ready to be connected to the swivel arrangement as illustrated in FIG. 4.

It should be understood that the processes described in FIG. 3-7 are operations that can be automated by the use of sensors, receivers, distance meters, angle meters and the like.

In the preceding description, various objects, features, aspects and advantages according to the invention have been described with references to the illustrative embodiments. For purposes of explanation, specific numbers, systems and configurations were set forth in order to provide a thorough understanding of the system and its workings. However, this description is not intended to be construed in a limiting sense. Various modifications and variations of the illustrative embodiment, as well as other embodiments of the system, which are apparent to persons skilled in the art to which the disclosed subject matter pertains, are deemed to lie within the scope of the present invention.

LIST OF REFERENCE NUMERALS/LETTERS

1 vessel
2 bow
3 upper part of the bow/upper bow
4 lower part of the bow/lower bow
5 protruding receiving structure/buoy support
5*a* upper end of the receiving structure
5*b* lower end of the receiving structure
6 buoyant turret buoy
6*a* upper end of the buoyant turret buoy
6*b* lower end of the buoyant turret buoy
7 recess/buoy opening
8 cavity
9 locking arrangement/buoy lock/clamp
10 rotary table
11 protruding deck structure
12 winch
13 mooring line (of the buoyant turret buoy)
13*a* mooring line connection
13*b* mooring line stopper
14 riser
15 turret shaft section (of the turret buoyant buoy)/turret shaft
15*a* extending channel of the turret shaft section
16 lower section of the turret shaft
17 connecting section/connecting face (of the buoyant turret buoy)/radial extension
17*a* hook of the connecting section
17*b* incision of the connecting section
18 winch wire
19 pick-up assembly/pick up cable
20 lifting and toque section
21 swivel arrangement
22 hang-off structure
23 attaching arrangement/hank
24 buoyancy section of the buoyant turret buoy
25 resting position
26 closing valves/ESD valves
D deck
w water line/water level

The invention claimed is:

1. A method for connecting a buoyant turret buoy located at sea to a receiving structure of a bow of a vessel for storing and/or producing hydrocarbons, wherein the vessel comprises a deck and a hull, wherein the hull further comprises a bow having an upper part and a lower part, wherein the bow further comprises a receiving structure fixed to the bow by welding for connecting a buoyant turret buoy to the bow, such that the receiving structure protrudes from an outer surface of the bow in the vessel's direction of travel, and wherein a minor part of the receiving structure protrudes from the upper part of the outer surface of the bow, while a main part of the receiving structure protrudes from the lower part of the outer surface of the bow, wherein an interface of the receiving structure is complementary to an interface of a connecting section of the buoyant turret buoy, and wherein the upper part of the bow is arranged above a water line and the lower part of the bow is arranged below the water line during connection and/or disconnection of the buoyant turret buoy at sea, and wherein the turret buoy comprises a buoyancy section for making the buoyant turret buoy neutrally or positively buoyant when submerged in a body of water and a turret shaft section for guiding one or more risers therein, a connecting section for connecting the buoyant turret buoy to the receiving structure of the bow of the vessel, wherein an interface of the connecting section is complementary to an interface of the receiving structure, and wherein the method comprises the steps of:

a) connecting a winch wire hanging from a winch fixed to the vessel to a pick-up assembly connected to the buoyant turret buoy floating at or below the water line of a body of water, b) lifting the buoyant turret buoy by the winch until the connecting section of the buoyant turret buoy is in a position where an upper end of the connecting section is in line with, or near in line with, an upper end of the receiving structure, and c) locking the buoyant turret buoy to the receiving structure by utilizing at least one locking arrangement fixed to the upper end of the receiving structure and at least one attaching arrangement fixed to the upper end of the connection section of the buoyant turret buoy, d) connecting the winch wire to a mooring line, e) pulling the mooring line through a mooring line connection and a mooring line stopper, until the mooring line is tightened, f) removing the part of the mooring line which has passed through the mooring line stopper and the mooring line connection, g) repeating steps d) to f) for all the mooring lines, h) connecting the winch wire to a lifting and torque section attached to a vertically extending channel within or above an upper end of the turret shaft section of the buoyant turret buoy, wherein the buoyant turret buoy comprises at least one riser attached to the lifting and torque section, i) lifting the vertically extending channel comprising the lifting and torque section and the at least one riser through a rotary table protruding from the upper part of the bow using the winch, j) attaching the lifting and torque section to a hang off structure on or above a rotary table, and k) connecting a swivel arrangement to the at least one riser.

* * * * *